US006426670B1

(12) United States Patent
Tanaka

(10) Patent No.: US 6,426,670 B1
(45) Date of Patent: Jul. 30, 2002

(54) POWER CIRCUIT WITH COMPARATORS AND HYSTERESIS

(75) Inventor: Toshimasa Tanaka, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 0 days.

(21) Appl. No.: 09/650,295

(22) Filed: Aug. 29, 2000

(30) Foreign Application Priority Data

Aug. 30, 1999 (JP) ..... 11-242509

(51) Int. Cl.[7] ..... G05F 1/46

(52) U.S. Cl. ..... 327/541; 327/543; 323/274; 323/275; 323/280; 323/281; 345/211

(58) Field of Search ..... 327/112, 538, 327/540, 541, 543; 323/311, 313, 274, 275, 280, 281, 283, 284; 345/98, 99, 211, 212

(56) References Cited

U.S. PATENT DOCUMENTS 5,087,834 A * 2/1992 Tsay ..... 327/541
5,317,254 A * 5/1994 Olson ..... 327/530
5,821,808 A * 10/1998 Fujima ..... 327/541
5,936,455 A * 8/1999 Kobayashi et al. ..... 327/530

FOREIGN PATENT DOCUMENTS

| | | | |
|---|---|---|---|
| DE | 19732671 | 4/1998 | ..... H03K/5/24 |
| EP | 0-631269 | 12/1994 | ..... G09G/3/36 |
| EP | 0-929193 | 7/1999 | ..... H04N/5/14 |

* cited by examiner

*Primary Examiner*—Timothy P. Callahan
*Assistant Examiner*—Terry L. Englund
(74) *Attorney, Agent, or Firm*—Hogan & Hartson, L.L.P.

(57) ABSTRACT

A power circuit having an output stage which includes voltage followers. The power circuit comprises first and second switching elements, respectively, connected between two voltage sources. A first comparator is provided to compare an input voltage with the output voltage of a voltage follower associated with the input voltage, and turn on the first switching element if the output voltage exceeds the input voltage. In addition, a second comparator is provided to compare the output voltage with a reference voltage to turn on the second switching element if the output voltage becomes lower than the reference voltage. A reference voltage circuit changes the value of the reference voltage depending on the output of the second comparator.

20 Claims, 6 Drawing Sheets

POWER CIRCUIT WITH COMPARATORS AND HYSTERESIS

FIELD OF THE INVENTION

The invention relates to a power circuit for performing impedance conversion of a given voltage to provide an output, in particular to a power circuit for use in a liquid crystal display (LCD) apparatus which requires a multiplicity of voltage sources.

BACKGROUND OF THE INVENTION

Apparatuses have been commonly used as display means for portable communication devices such as cellular phones and pagers. In an LCD apparatus, a drive circuit is used to drive a multiplicity of display elements or pixels in a given duty cycle using a multiplicity of bias voltages as shown in FIG. 1.

The LCD apparatus of FIG. 1 comprises:

- a bias circuit 11 for generating a multiplicity of bias voltages by dividing a voltage between a source voltage Vdd and a ground voltage E by a multiplicity of series resistors each having a resistance of about 1 M Ohms;
- a buffer circuit 12 having voltage followers 121–123 for generating outputs by impedance conversion of the respective bias voltages;
- a selection circuit 13 for selectively applying the output voltages of the buffer circuit 12 to the display elements 141 of the LCD to be activated in accordance with the display data; and
- a display panel 14 on which a display pattern associated with the display data is formed by the pixels 141 thus activated.

In the duty operation by the multiplicity of bias voltages, those pixels having voltages applied to the electrodes thereof in excess of a predetermined level will be turned on.

An LCD apparatus having such arrangement must be operated at a low power on the one hand in order to maximize the life of the LCD as much as possible, but on the other hand, in order to provide a good display quality, it must be operable by a large driving power to prevent deterioration of output waveforms especially for a large capacitive load.

To meet these conflicting requirements, conventional LCD apparatuses employ a power circuit formed of voltage followers in a buffer circuit as shown in FIGS. 2 and 3.

As shown in FIG. 2, connected between the source voltage Vdd and the ground voltage E are a constant current source I11 and an N channel MOSFET Q11 connected in series with each other, providing at the node therebetween an output voltage Vo. A difference amplifier CP11 is also provided in the power circuit, having a negative or inverting input terminal for receiving an input voltage Vin and a positive or non-inverting input terminal for receiving the output voltage Vo, and generating a gate voltage for the MOSFET Q11.

In the power circuit shown in FIG. 2, a constant current i1 is provided from the constant current source I11. The input voltage Vin and the output voltage Vo are compared in the difference amplifier CP11 to control switching operation of the MOSFET Q11. The output voltage Vo is controlled to balance the input voltage Vin.

In an LCD apparatus capacitive loads are driven by combinatory voltages formed of different bias voltages, which cause such output voltage Vo to fluctuate up and down. Thus, the output voltage Vo deviates off a predetermined voltage for unspecified noise sources. In what follows a noise that causes an upward shift of the output voltage Vo will be referred to as positive noise or H noise, and a noise that causes a downward shift of the output voltage Vo will be referred to as negative noise or L noise.

In the power circuit shown in FIG. 2, as the output voltage Vo is pushed up appreciably by an H noise, the MOSFET Q11 is turned on by the output voltage of the difference amplifier CP11 to lower the output voltage Vo, until the output voltage Vo balances the input voltage Vin. Thus, the ability of the circuit to lower the output voltage Vo raised by a positive noise depends on the driving power of the MOSFET Q11.

On the other hand, if the output voltage Vo is lowered by an L noise, the MOSFET Q11 is turned off by the output of the difference amplifier CP11, and a s a result, a constant current i1 is supplied from the constant current source I11, which gradually pushes up the output voltage Vo. The output level of the difference amplifier CP11 will become high to turn the MOSFET Q11 as t he output voltage Vo equals the input voltage Vin, thereby keeping the output voltage Vo at the same level of the input level Vin. Thus, the ability of the power circuit to raise lowered output voltage Vo is determined by th e magnitude of the constant current i1 from the constant current source I11.

It is noted that the MOSFET Q11 keeps the current i1 flowing to have the output voltage Vo balancing the input voltage Vin.

In this way, in order to suppress noises, especially L noises, it is necessary to make the constant current i1 sufficiently large, which opposes, however, the aforementioned requirement that the power to drive the LCD circuit should be low.

FIG. 3 illustrates a conventional circuit with an improvement to overcome such problem as discussed above in conjunction with FIG. 2, in which a P channel MOSFET Q12 and a further constant current source I12 are connected in parallel with the constant current source I11. The basic structure and function of the improved circuit are the same as those of FIG. 2.

In the arrangement shown in FIG. 3, the MOSFET Q12 is supplied at the gate thereof with a periodic control signal for turning on the MOSFET Q12 at times when noises are supposedly likely to superpose on the output voltage Vo, thereby turning on the MOSFET Q12 to provide an extra constant current i2 from the constant current source I12 superposing on the constant current i1 from the constant current source I11, which adds to the power circuit a counteractive power against L-noises.

However, in this arrangement, the MOSFET Q12 is turned on periodically, irrespective of whether a noise exists affecting the output voltage Vo or not. Hence, although anti-L noise capacity is improved a little, the improvement cannot be a fundamental solution to the drive circuit for LCD apparatus.

"We see therefore that conventional drive circuits still suffer from a contradiction in suppressing the constant current on the one hand to prolonging the life of an LCD apparatus, and enhancing the current to suppress noises, especially L noises."

SUMMARY OF THE INVENTION

In accordance with one aspect of the invention, there is provided a power circuit comprising:

- a first switching element connected between an output terminal of the power circuit and a first voltage supply;
- a second switching element connected between a second voltage supply and the output terminal;

a first comparator for comparing an input voltage with an output voltage at the output terminal, to turn on the first switching element if the output voltage exceeds the input voltage;

a second comparator, having an input end and an output end, for comparing the output voltage with a reference voltage, to turn on the second switching element if the output voltage becomes lower than the reference voltage; and a reference voltage circuit for changing the reference voltage depending on a voltage value at the output end.

The second switching element of the power circuit is turned on in raising the output voltage, so that the power need to run a load is significantly reduced as compared with conventional constant current type power circuits.

The second comparator exhibits hysteresis during operation. The hysteresis of the second comparator controlling the second switching element may improve noise reduction, and hence output distortions caused by the noise in the power circuit.

By controlling the first and second comparators, respectively, so as not to make the first and the second switching elements conductive simultaneously, no inter-power supply current will be generated in the power circuit. Thus, power consumption by the power circuit of the invention is greatly reduced.

The reference voltage circuit may include a resistor and a third switching element controlled by the voltage value at the output end and provided between the input end of the second comparator for receiving the reference voltage and either one of the first voltage supply and the second voltage supply.

In this arrangement, the reference voltage to the second comparator is automatically switched between two levels in accordance with the output of the second comparator. In other words, the arrangement adds to the second comparator a hysteresis character with respect to the output voltage.

The third switching element as well as the first and the second switching elements, respectively, can be MOSFETs.

Further, the first switching element can be an N channel MOSFET, the second switching element can be a P channel MOSFET, and the third switching element can be an N channel MOSFET.

The power circuit having this arrangement can control the switching elements involved at a very low power in response to the output voltages of the first and second comparators, respectively.

In accordance with another aspect of the invention, there is provided a display apparatus comprising a bias circuit, a buffer circuit electrically coupled to the bias circuit, a selection circuit electrically coupled to the buffer circuit, and a display panel electrically coupled to the selection circuit, wherein the buffer circuit is made up of the previously mentioned power circuit.

DETAILED DESCRIPTION OF THE PREFERRED EMBODIMENT

Figure 4:
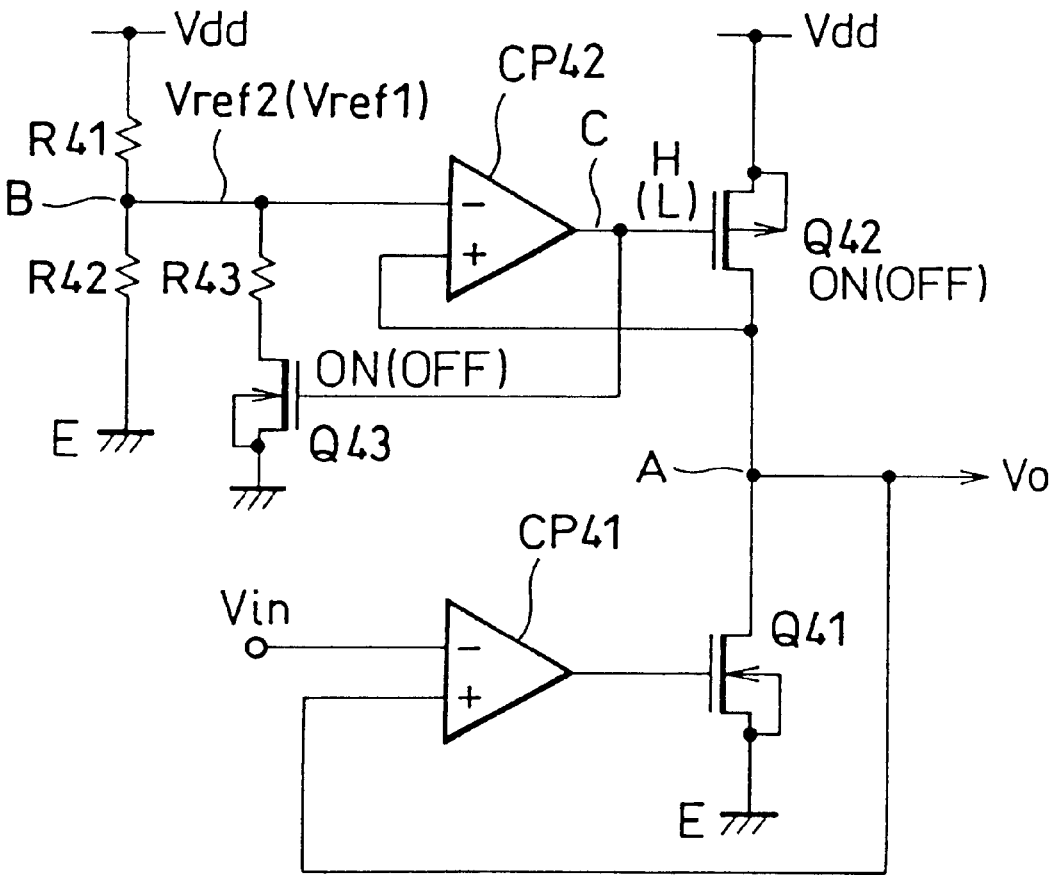
FIG. 4 is a circuit diagram of a power circuit according to the invention.

Referring now to FIGS. 4 though 7, the invention will now be described in detail. Referring first to FIG. 4, there is shown an exemplary power circuit according to the invention for use as voltage followers for example.

As shown in FIG. 4, a P channel MOSFET Q42 and an N channel MOSFET Q41 are connected in series between a first voltage supply providing a supply voltage Vdd and a second voltage supply E providing the ground voltage, to generate at the node A thereof an output voltage Vo. The MOSFET Q42 serves as a switch for supplying electric power to a capacitive load such as a common electrode of an LCD selectively connected to the node A, while the MOSFET Q41 serves as a switch for draining electric energy from the load.

When an input voltage Vin is entered at an inverting terminal of a difference amplifier CP41, and the output voltage Vo is entered at a non-inverting input terminal of the difference amplifier CP41, the difference amplifier CP41 serves as a comparator comparing the two inputs to generate an output, which is supplied to the gate of the MOSFET Q41.

The inverting input terminal of the difference amplifier CP42 is supplied with a reference voltage Vref which selectively assumes either a high reference voltage Vref1 or a low reference voltage Vref2 in accordance with the condition of the power circuit. The output voltage Vo is input to the non-inverted input terminal of the difference amplifier CP42 serving as a comparator. The output voltage Vo is compared with the reference voltage. The output of the comparator (potential at point C) is applied to the gate of the MOSFET Q42. Connected between the voltage supply at voltage Vdd and the ground at voltage E are resistors R41 and R42 connected in series. A resistor R43 and an N channel MOSFET Q43 connected in series with each other are connected in parallel with the resistor R42.

Consequently, point B has a reference voltage which equals either Vdd×R42/(R41+R42) (referred to as the high reference voltage Vref1) or Vdd×(R42×R43)/(R41×R42+R42×R43+R43×R41) (referred to as lower reference voltage Vref2), depending on whether the MOSFET Q43 is turned on or off.

The gate of the MOSFET Q43 is connected to the output of the difference amplifier CP42, so that the gate has the same voltage as the output. Hence the difference amplifier CP42 exhibits a hysteresis.

Figure 1:
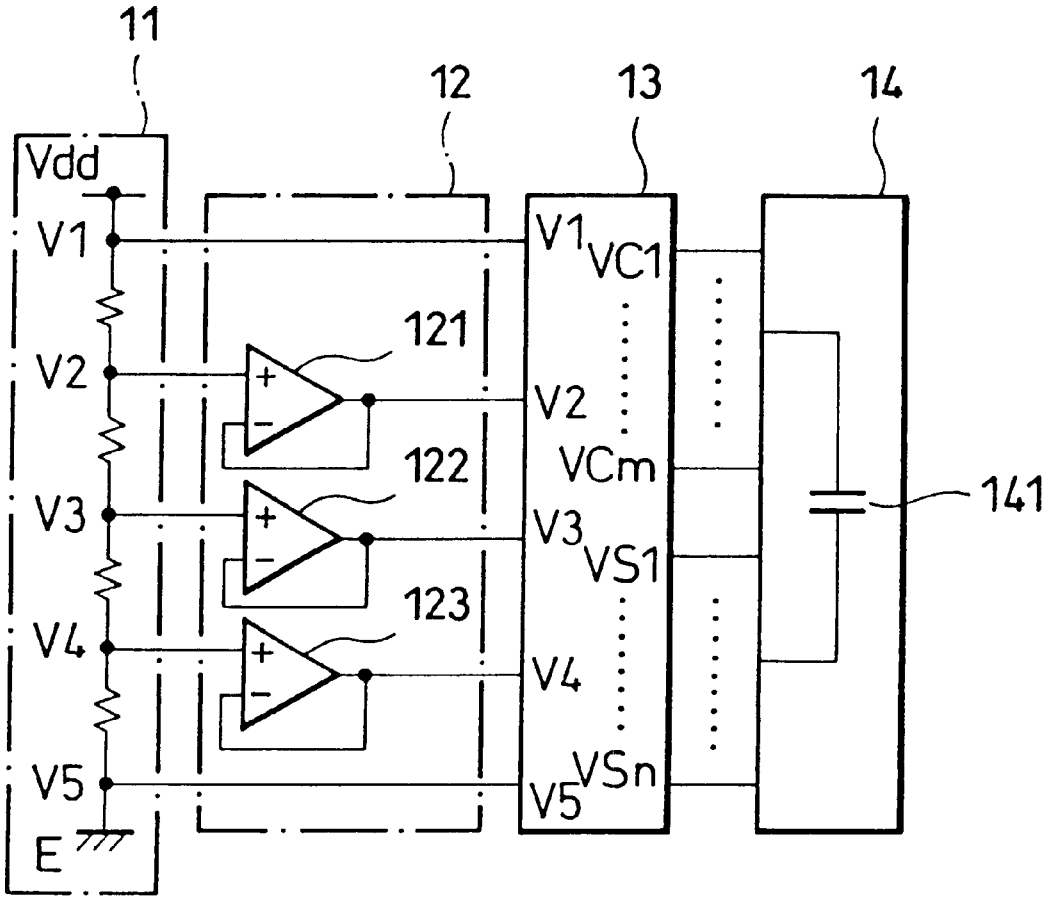
FIG. 1 PRIOR ART
FIG. 1 is a schematic view of a typical LCD apparatus.
Figure 2:
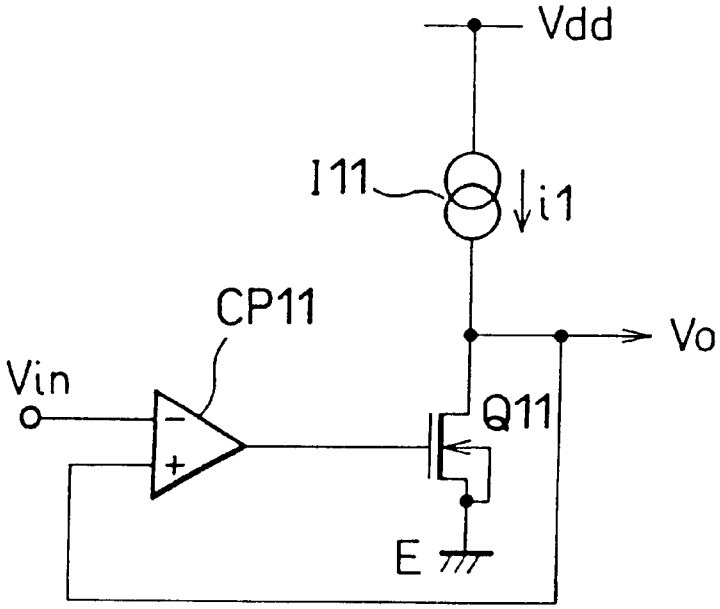
FIG. 2 PRIOR ART
FIG. 2 is a conventional power circuit for use in an LCD as shown in FIG. 1.
Figure 3:
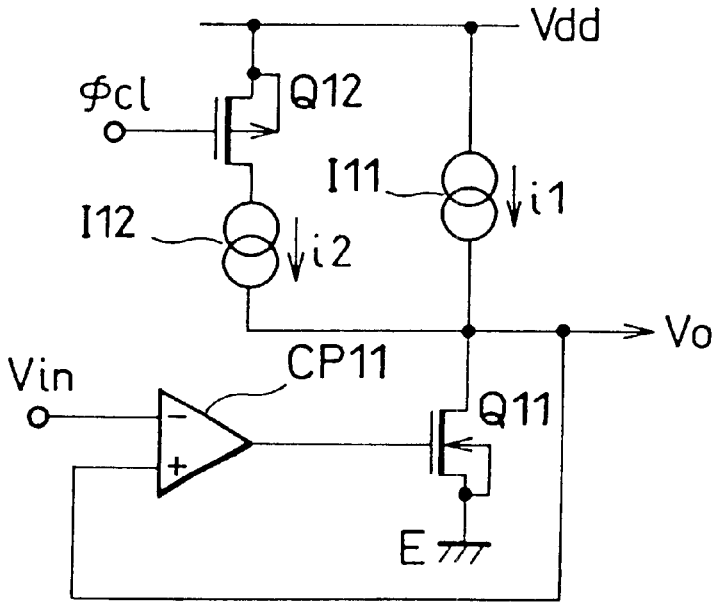
FIG. 3 PRIOR ART
FIG. 3 is a similar conventional power circuit.

In most cases, the high reference voltage Vref1 is the same as the input voltage Vin. Any one of the outputs of the bias circuit 11 of LCD apparatus shown in FIG. 1 can be used as the input voltage Vin.

Figure 5:
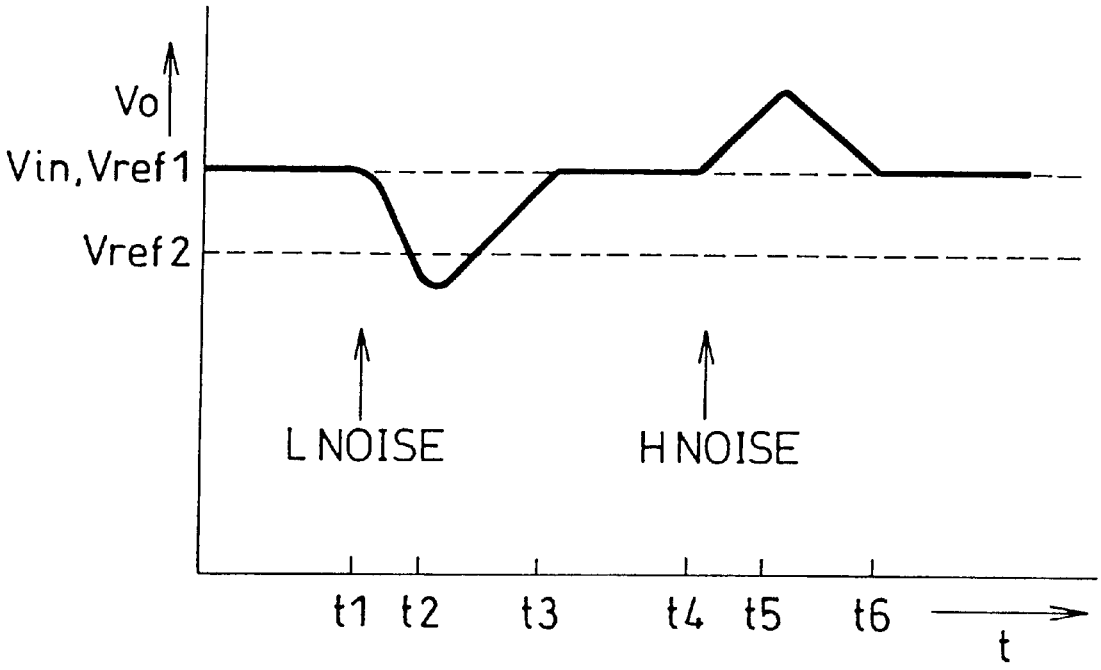
FIG. 5 is a graph illustrating a behavior of the power circuit of FIG. 4.

Referring to FIG. 5, the operation of the power circuit shown in FIG. 4 will now be described. This power circuit may be used as a drive circuit of an LCD apparatus in driving capacitive loads, where various bias voltages are generated and used in combination. The power circuit shown in FIG. 4 may provide such bias voltage, thus, under the influences of these bias voltages, the output voltage Vo deviates from a predetermined level because it is pushed up by H noises or pulled down by L noises.

Under a normal operating condition, the output voltage Vo is substantially the same as the input voltage Vin, and the MOSFET Q42 is turned off. The condition of the MOSFET Q41 is indefinite in that it can assume the ON state and the OFF state equally well. Meanwhile, the output of the difference amplifier CP42 is at H level and the MOSFET Q43 is in the ON state, so that the B point voltage equals the lower reference voltage Vref2.

To help readers understand the operation of the power circuit, relationships among various voltages involved is shown below, using tentative voltages.

$$Vin\ (3.0\ \text{V}) = Vo\ (\text{under normal operation})$$

$$= Vref1 > Vref2\ (2.7\ \text{V})$$

If an L noise is superposed on the output voltage Vo (at time t1), the output voltage Vo tends to decrease. As the output voltage Vo is lowered to the level of the reference voltage Vref2, the output of the difference amplifier CP42 is inverted, generating at the output terminal thereof a low level voltage L. Consequently, the MOSFET Q42 is turned ON, resulting in a current flowing from the voltage supply at Vdd through the MOSFET Q42. At the same time, the MOSFET Q43 is turned OFF, providing the difference amplifier CP42 with the high reference voltage Vref1.

If, however, the output voltage Vo is lower than the normal operating voltage, i.e. Vin, the MOSFET Q41 is turned OFF since then the output voltage of the MOSFET Q41 is low L.

Upon activation of the MOSFET Q42, a current is supplied from the voltage supply Vdd to the load. If a large L noise exists, the output voltage Vo will become lower than the reference voltage Vref2 (at time t1) and will begin to increase some time later at time t2. In this case, since the reference voltage of the difference amplifier CP42 is high Vref1, the current keeps flowing from the supply voltage Vdd through the MOSFET Q42 which causes the output voltage Vo to rise above the low reference voltage Vref2.

As the output voltage Vo reaches the high reference voltage Vref1 at time t3, the output of the difference amplifier CP42 is inverted to high level H. This turns the MOSFET Q42 off and the MOSFET Q43 on, so that the reference voltage Vref for the difference amplifier CP42 becomes low Vref2, thereby allowing the power circuit to restore the normal operating condition.

In short, in the power circuit shown in FIG. 4, the difference amplifier CP42 has hysteresis with respect to the output voltage Vo.

If, on the other hand, an H noise is superposed on the output voltage Vo during a normal operation, at time t4 say, the output voltage Vo rises. It continues to increase until it exceeds the input voltage Vin, when the output of the difference amplifier CP41 becomes high H to turn on the MOSFET Q41.

While the output voltage Vo is above the normal level, the output of the difference amplifier CP42 is high H and the MOSFET Q42 is turned off.

As the MOSFET Q41 is turned on, a current is drawn from the load. Meanwhile, the output voltage Vo increases above the input voltage Vin due to the energy of the H noise, and begins to decrease later at time t5. The output voltage Vo will further decrease, until it balances the input voltage Vin at t6 say to turn off the MOSFET Q41, allowing the power circuit to return to the normal operating condition.

Figure 6:
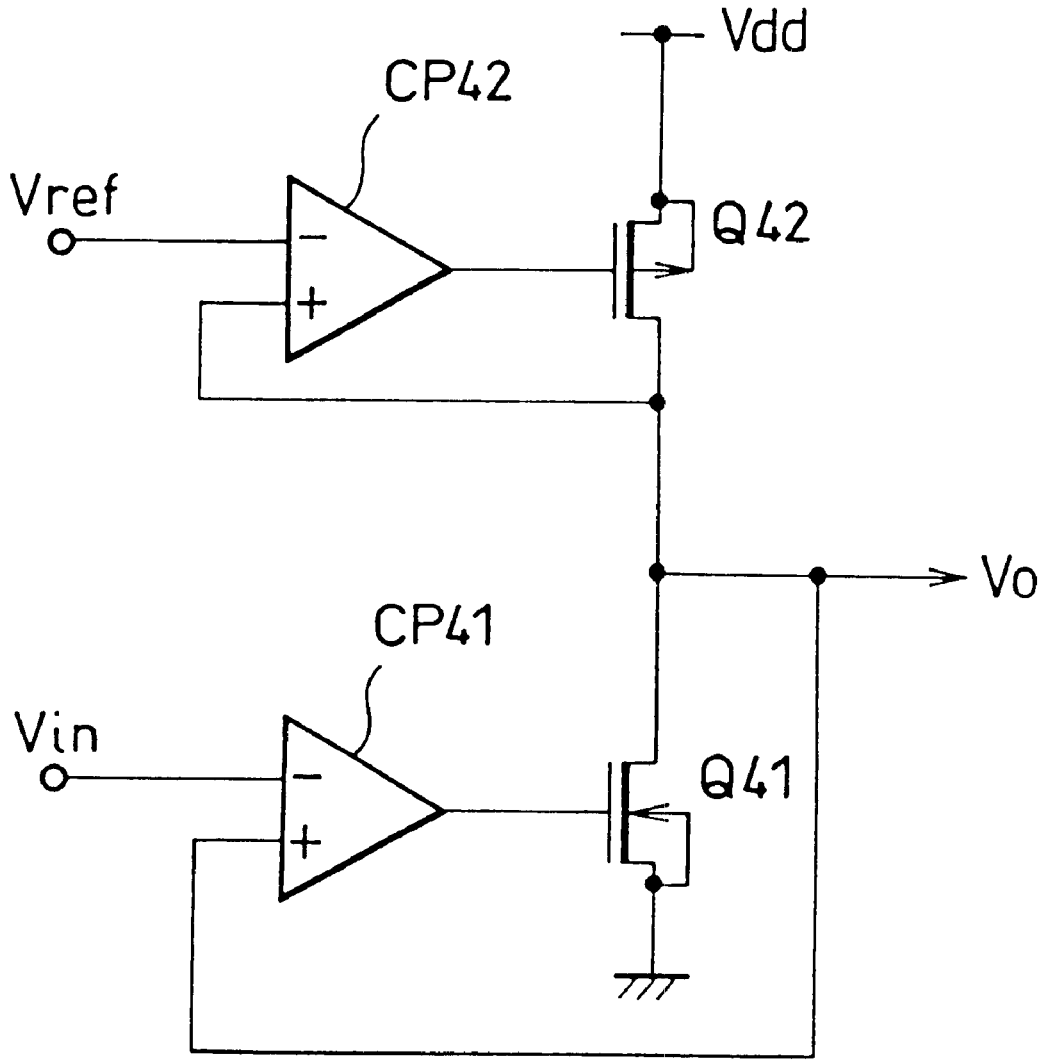
FIG. 6 is a circuit useful in understanding the power circuit of FIG. 4 of the invention.
Figure 7:
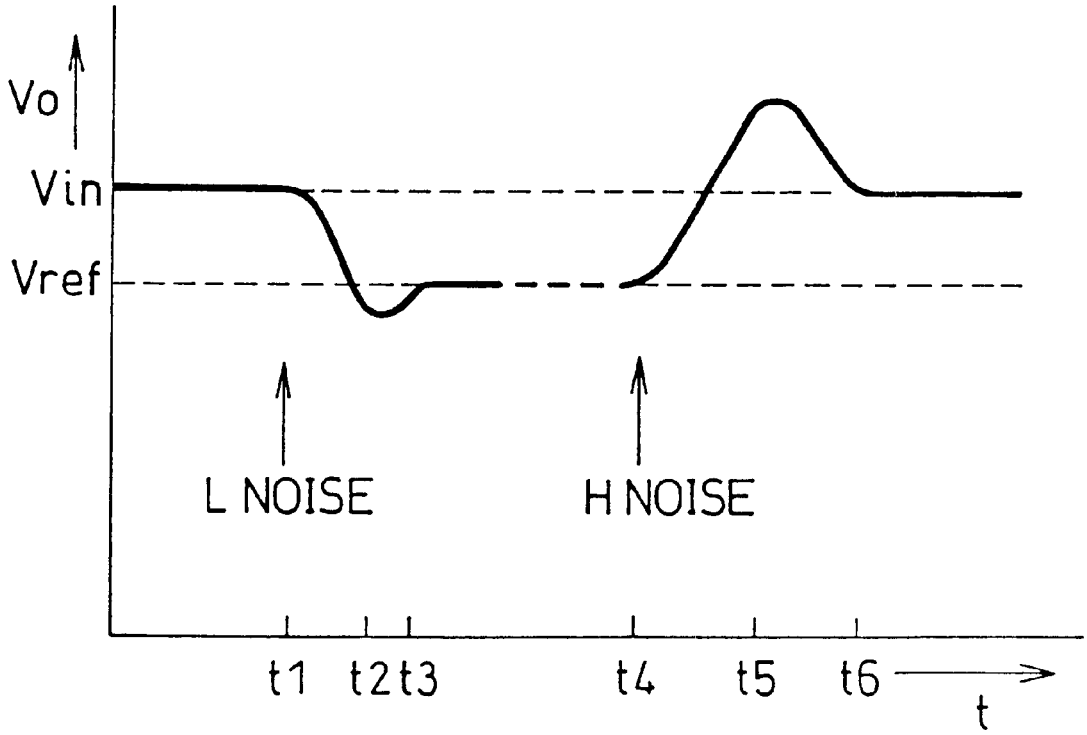
FIG. 7 is a graph illustrating a behavior of the circuit of FIG. 6.

It is seen that the power circuit of the invention advantageously operates as describe above, owing to the hysteresis character of the difference amplifier CP42. This feature of the invention will be better understood by comparing the invention with a referential circuit as shown in FIG. 6, having no hysteresis character. The behavior of the circuit of FIG. 6 is shown in FIG. 7.

The referential circuit shown in FIG. 6 has the same structure as the inventive circuit shown in FIGS. 4 and 5 except that the former circuit has only one reference voltage Vref.

In the referential circuit shown herein the reference voltage Vref is set a little lower than that of the input voltage Vin. Since the driving power of the MOSFET Q42 is made as large as that of the MOSFET Q41 to enable quick absorption of noise from the load, this lower setting of the reference voltage is necessary because otherwise the MOSFET Q41 and the MOSFET Q42 would be simultaneously conducted, resulting in a large current between the voltage supply at Vdd and the ground.

Under a normal operating condition where the output voltage Vo is held at the input voltage Vin, if an L noise is superposed on the output noise Vo (at time t1), the output voltage Vo decreases with time as low as the reference voltage Vref, at which the difference amplifier CP42 is inverted and its output shifts to a low level L. Thus, the MOSFET Q42 is turned on, causing the voltage supply Vdd to supply a current to the load.

On account of the energy brought by the L noise, the output voltage Vo is further lowered below the reference voltage Vref, until the energy is exhausted at time t2 when the output voltage Vo begins to rise.

When the output voltage Vo balances the reference voltage Vref at time t3, the output of the difference amplifier CP42 is inverted from L to H, so that the MOSFET Q42 is turned off. Consequently, the output voltage Vo remains at the level of the reference voltage Vref which is lower than the anticipated normal output voltage.

If then an H noise is superposed on the output voltage Vo (at time t4) while the output voltage Vo is at Vref, the output voltage Vo begins to rise. As the output voltage Vo exceeds the input voltage Vin, the difference amplifier CP41 is turned on by the high output (H) of the difference amplifier CP41.

The output voltage Vo overshoots the input voltage Vin due to the energy of the H noise at t5, and thereafter begins to decrease as shown in FIG. 7. The output voltage Vo continues to decrease until it balances the input voltage Vin at time t6, when the MOSFET Q41 is turned off to restore the normal operating condition of the power circuit.

In this way, once disturbed by an L noise, the power circuit can recover the output voltage only up to the reference voltage Vref if the difference amplifier CP42 has no hysteresis character. Therefore, the distortion in the output of the power circuit caused by an L noise remains as much as (Vin−Vref), unless an H noise follows the L noise as shown in FIG. 7. However, one may not always anticipate such H noise to restore the output.

As a solution to eliminate such L noise distortion, the reference voltage Vref could be set equal to or close to the input voltage Vin. However, since there is always some error involved in setting the reference voltage and there is always some allowance in the rating of the components used, it is difficult to set up an exact reference voltage Vref as desired, and therefore there is always a chance of simultaneous conduction of the MOSFET Q41 and MOSFET Q42, which results in a so-called inter-power supply current between the power supplies. In order to avoid such drawbacks, it is inevitable to set the reference voltage Vref a little lower than the input voltage Vin.

In contrast, the invention allows the MOSFET Q42 to be turned on only when a current is required for the load or for raising the lowered output voltage Vo to the normal level, as described in conjunction with FIGS. 4 and 5. This implies that the impedance of the MOSFET Q42 can be very small. Thus, the power circuit of the invention can provide a much greater current to the load as compared with conventional constant current type power circuits, which implies that the power circuit of the invention has an enhanced driving power to a highly capacitive load.

It will be recalled that because of the hysteresis character of the difference amplifier CP42 controlling ON/OFF operations of the MOSFET Q42, the power circuit of the invention can minimize the influences of both H noises and L noises. It should be appreciated that the output voltage Vo can be set to a given input voltage Vin from above and below Vin, corrected to the level of the input voltage Vin if the output voltage is deviated above or below Vin.

It will be also recalled that the current providing MOSFET Q42 and the current absorbing MOSFET Q41 are conditioned not to be conductive simultaneously by the respective difference amplifiers CP41 and CP42, so that an inter-source current will never be incurred. In addition, the power consumption by the power circuit will be negligibly small if the load is capacitive. Thus, the invention enables a design of a compact power circuit which includes advantageously smaller elements such as MOSFETs consuming only a small amount of electric energy.

What I claim is:

1. A power circuit comprising:

a first switching element connected between an output terminal of the power circuit and a first voltage supply;

a second switching element connected between a second voltage supply and said output terminal;

a first comparator for comparing an input voltage with an output voltage at said output terminal, to turn on said first switching element if said output voltage exceeds said input voltage;

a second comparator, having an input end and an output end, for comparing said output voltage with a reference voltage, to turn on said second switching element if said output voltage becomes lower than said reference voltage; and a reference voltage circuit for changing said reference voltage depending on a voltage value at said output end.

2. The power circuit as set forth in claim 1, wherein said reference voltage circuit includes a resistor and a third switching element controlled by said voltage value at said output end and provided between said input end of said second comparator for receiving said reference voltage and either one of said first voltage supply and said second voltage supply.

3. The power circuit as set forth in claim 2, wherein said first, second and third switching elements are MOSFETs.

4. The power circuit as set forth in claim 3, wherein said first switching element is an N channel MOSFET and said second switching element is a P channel MOSFET.

5. The power circuit as set forth in claim 3, wherein said third switching element is an N channel MOSFET.

6. The power circuit as set forth in claim 1, wherein said second comparator exhibits hysteresis during operation.

7. A display apparatus comprising:

a bias circuit;

a buffer circuit electrically coupled to said bias circuit comprising;

a first switching element connected between an output terminal of said buffer circuit and a first voltage supply;

a second switching element connected between a second voltage supply and said output terminal;

a first comparator for comparing an input voltage with an output voltage at said output terminal, to turn on said first switching element if said output voltage exceeds said input voltage;

a second comparator, having an input end and an output end, for comparing said output voltage with a reference voltage, to turn on said second switching element if said output voltage becomes lower than said reference voltage; and a reference voltage circuit for changing said reference voltage depending on a voltage value at said output end; and a selection circuit electrically coupled to said buffer circuit; and a display panel electrically coupled to said selection circuit.

8. The display apparatus as set forth in claim 7, wherein said reference voltage circuit includes a resistor and a third switching element controlled by said voltage value at said output end and provided between said input end of said second comparator for receiving said reference voltage and either one of said first voltage supply and said second voltage supply.

9. The display apparatus as set forth in claim 8, wherein said first, second and third switching elements are MOSFETs.

10. The display apparatus as set forth in claim 9, wherein said first switching element is an N channel MOSFET and said second switching element is a P channel MOSFET.

11. The display apparatus as set forth in claim 9, wherein said third switching element is an N channel MOSFET.

12. The display apparatus as set forth in claim 7, wherein said second comparator exhibits hysteresis during operation.

13. A method of providing power, comprising the steps of:

comparing an input voltage with an output voltage;

turning on a first switching element if said output voltage exceeds said input voltage;

comparing said output voltage with a reference voltage, wherein said reference voltage can change in value between at least two different voltage values without a corresponding change in said input voltage; and turning on a second switching element if said output voltage is lower than said reference voltage.

14. The method as set forth in claim 13, wherein said first and second switching elements are MOSFETs.

15. The method as set forth in claim 14, wherein said first switching element is an N channel MOSFET and said second switching element is a P channel MOSFET.

16. The method as set forth in claim 13, further comprising the step of turning on a third switching element if said output voltage exceeds said reference voltage.

17. The method as set forth in claim 16, wherein said first, second, and third switching elements are MOSFETs.

18. The method as set forth in claim 17, wherein said first switching element and said third switching element are N channel MOSFETs, and said second switching element is a P channel MOSFET.

19. The method as set forth in claim 13, wherein said voltage value of said reference voltage is one value when said output voltage is greater than said reference voltage and another value when said output voltage is less than said reference voltage.

20. The method as set forth in claim 13, wherein hysteresis is exhibited during said comparing of said output voltage with said reference voltage.

* * * * *